US005740919A

United States Patent [19]

Stowe

[11] Patent Number: 5,740,919

[45] Date of Patent: Apr. 21, 1998

[54] MAGNETIC SEPARATOR

[76] Inventor: Michael W. Stowe, 3923-C Pine Hurst Shore Dr., Boyne City, Mich. 49712

[21] Appl. No.: 812,242

[22] Filed: Mar. 5, 1997

Related U.S. Application Data

[63] Continuation of Ser. No. 373,768, Jan. 17, 1995, abandoned.

[51] Int. Cl.[6] ..... B03C 1/00

[52] U.S. Cl. ..... 209/223.1; 209/225; 209/228

[58] Field of Search ..... 209/213, 223.1, 209/223.2, 225, 226, 228, 231

[56] References Cited

U.S. PATENT DOCUMENTS

| | | | |
|---|---|---|---|
| 3,498,455 | 3/1970 | Kirby, III | 209/223.1 |
| 3,524,549 | 8/1970 | Walter | 209/223.1 X |
| 4,319,989 | 3/1982 | Wyland et al. | 209/225 |
| 4,455,229 | 6/1984 | Sanderson et al. | 209/223.1 X |
| 4,946,589 | 8/1990 | Hayes | 209/223.1 X |

FOREIGN PATENT DOCUMENTS

| | | | |
|---|---|---|---|
| 2183507 | 6/1987 | United Kingdom | 209/223.1 |

*Primary Examiner*—Tuan Nguyen
*Attorney, Agent, or Firm*—Young & Basile, P.C.

[57] ABSTRACT

The present invention relates to a magnetic separator in the form of a conduit defined by axially mating halves. The magnet-containing housing disposed in the conduit includes an integral nose portion from which radiates a support member, the support member connecting the magnet-containing housing to one of the conduit halves.

36 Claims, 3 Drawing Sheets

MAGNETIC SEPARATOR

This application is a continuation of application Ser. No. 08/373,768 filed on Jan. 17, 1995, abandoned.

FIELD OF THE INVENTION

The present invention relates generally to a device for capturing tramp contaminants, such as ferrous contaminants, in industrial vacuum-loading applications. Specifically, this invention relates to a magnet-containing conduit having an improved design which permits greater contaminant capture and facilitates easy cleaning.

BACKGROUND OF THE INVENITON

A number of industries are devoted to the production and/or recycling of non-metallic products, such as plastics. However, metallic contaminants can ruin both raw and recycleable materials. One such contaminant is commonly known as tramp iron.

In the plastic molding industry, it is desirable to save and recycle excess plastic from molding machines after a particular product is formed. To this end, vacuum loaders capture the excess plastic and transfer it to a waiting hopper, or gaylord. However, tramp iron from the machining and molding process frequently becomes interspersed in the plastic. A common solution to this problem is to interpose contaminant capture devices between the vacuum loaders and the transportation or storage bins. These devices save great time and expense otherwise spent extracting contaminants or purchasing new raw materials.

It is further known that contaminant capture devices may be cylindrical conduits having a magnet disposed therein. U.S. Pat. No. 4,319,989 discloses such a device, wherein the magnet is externally accessible in order to periodically remove tramp iron and other contaminants. According to the '989 patent, however, the magnet is accessed through a hinged panel which forms part of the conduit wall. The magnet depends from the interior surface of this hatch, such that opening the hatch simultaneously lifts the magnet from the conduit.

An obvious drawback the '989 device is that it is difficult to effectively clean the entire magnet, since a portion of its surface is hidden by the hatch. A further drawback is the difficulty in accessing the magnet, given that service personnel must overcome the added weight of the magnet every time the hatch is opened.

The '989 patent also discloses that the conical nose of the device is immovably disposed in the conduit. The nose acts as a means of preserving laminar air flow over the magnet's blunt front end. But this configuration, wherein the magnet and the conical nose are two separate elements, requires additional materials and effort to manufacture and assemble.

SUMMARY OF THE INVENTION

It is therefore an object of the present invention to provide a contaminant-trapping device wherein the magnet is both more accessible and easier to clean thoroughly.

Yet another object of this invention is to provide for a contaminant-trapping device wherein the conical nose and the magnet comprise a unitary element.

These and other objects are achieved through a device comprising two axially mating conduit portions wherein the magnet-containing housing is connected by a support member to only one of the conduit portions, such that the portions can be separated to reveal the magnet-containing housing. In a second embodiment, the magnet-containing housing includes an integral nose portion by which the magnet-containing housing is supported in one of the conduit halves. In a further embodiment, the two conduit portions mate at a region just downstream from the nose portion, such that separation of the two portions reveals the entire, freely depending surface of the magnet.

DESCRIPTION OF THE ILLUSTRATED EMBODIMENT

Figure 1:
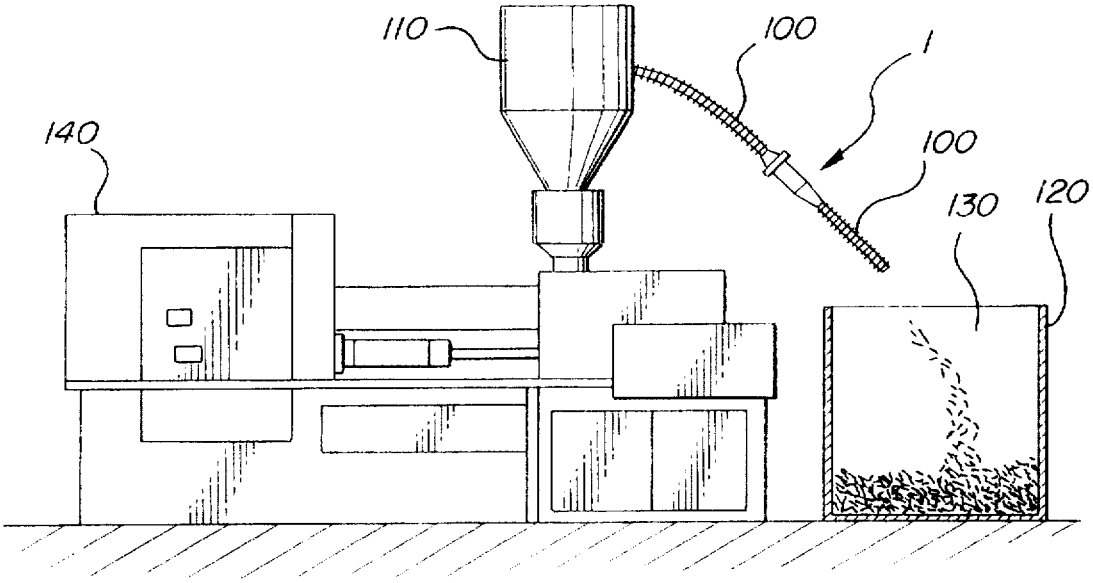
FIG. 1 depicts the invention as incorporated in one possible application.

Referring to FIG. 1, the device 1 of the present invention is shown in a simplified representation of one possible application. In this embodiment, the invention is disposed along a vacuum line 100; interposed between a vacuum loader 110 and a product hopper (or "gaylord") 120. In this embodiment, extraneous plastic 130 from a molding machine 140 is captured by the vacuum loader, which pneumatically transfers the plastic to the gaylord. Plastic collected in this fashion can then be recycled for future molding applications or other processing. Of course, applications other than that illustrated are possible without compromising the patentable features of this invention. One alternative application involves vertically orienting the device between sections of pipe in a gravity-flow separation system, such as used in the plastics recycling industry.

Figure 2:
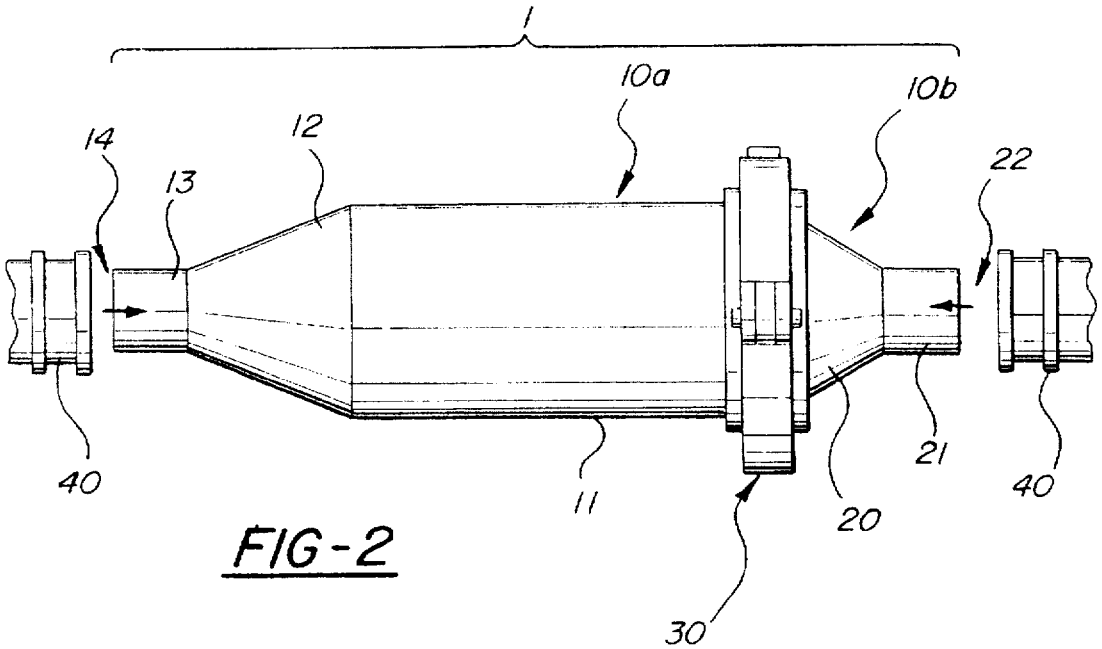
FIG. 2 is an exterior, lateral view of the present invention.

As shown in FIG. 2, the device 1 of this invention generally includes a hollow conduit comprising two axially mating halves 10*a* and 10*b* connected by a removable collar 30. Both conduit halves are of welded construction, being constructed from stainless steel or other non-magnetizable material. Conduit half 10*a* is somewhat larger in length, including a generally cylindrical region 11. However, the depicted device 1 is of an easily portable size. Each conduit half 10*a*, 10*b* includes similarly dimensioned frusto-conical portions 12, 20 of outwardly decreasing diameter. Both such frusto-conical portions end in cylindrical throat portions 13, 21; throat portion 13 defines the outlet 14 of the device, while portion 21 defines the inlet 22. The throat portions are aligned with the long axis of the device, each further being concentric with respect to cylindrical region 11. Throat portions 13 and 21 have similar diameters, each designed to be inserted into a length of pipe (not shown) or flexible tubing 40.

Figure 3:
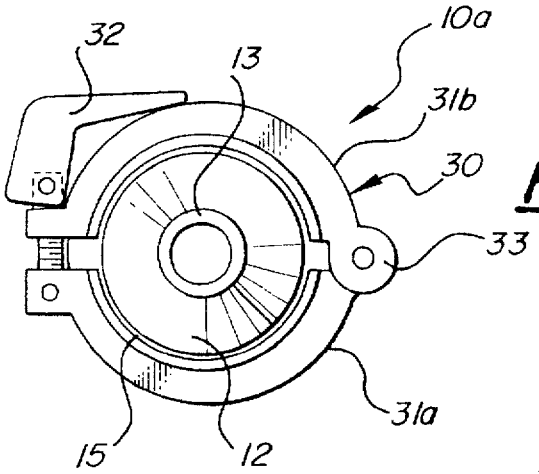
FIG. 3 is an exterior, rearward view of the present invention.
Figure 4:
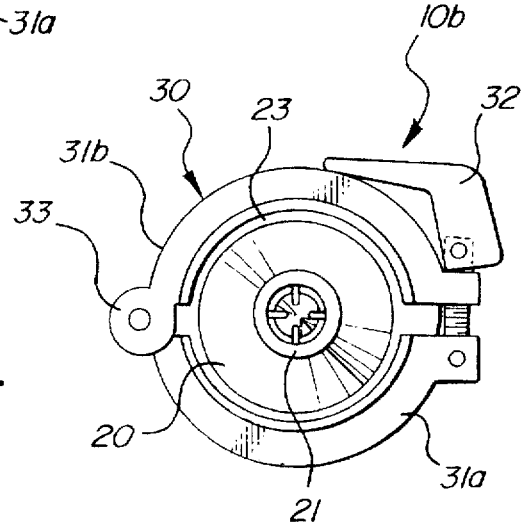
FIG. 4 is an exterior, forward view of the present invention.

Referring now to FIGS. 3 and 4, the concentric arrangement of the various portions of conduit halves 10*a* and 10*b* are visible. From both the rearward (FIG. 3) and frontal (FIG. 4) views, annular shoulder portions 15 and 23 are also shown. Annular shoulders 15 and 23 define the axially mating surfaces of each conduit half 10*a* or 10*b*, respectively. As illustrated, each annular shoulder is an integral, radiating extension of its respective conduit half. Of course, it is also possible that each shoulder be detachably connected to its respective conduit half.

Also visible in FIGS. 3 and 4 is the conduit mating collar 30. Preferably manufactured of stainless steel, mating collar 30 is characterized by an overall ring shape comprised of two "C"-shaped halves 31*a*, 31*b*, pivotally connected at joint 33. In the illustrated embodiment, collar 30 is releasably locked by a known cam-lever mechanism 32, wherein the cam is pivotally fixed to a free end of one half 31*a* and releasingly engages the free end of the other half 31*b*.

Figure 5:
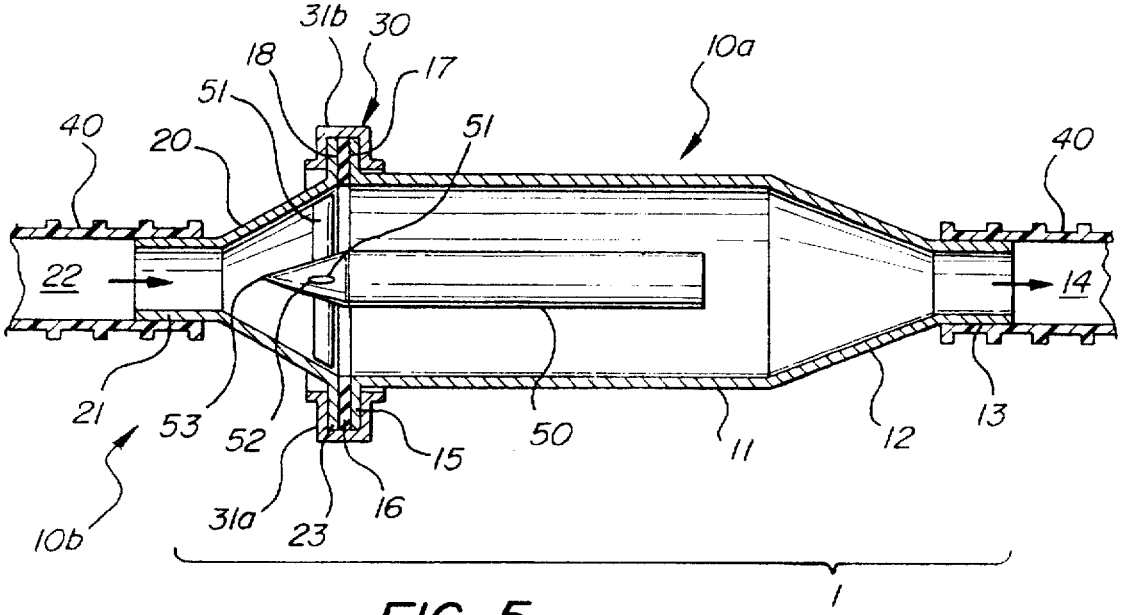
FIG. 5 is a cutaway, lateral view of the present invention.

As seen in FIG. 5, the magnet 50 is essentially rod-shaped and includes an integral, conical nose portion 53. Magnet 50 is aligned with the long axis of the conduit and extends approximately the length of cylindrical region 11 of conduit half 10*a*. Magnet 50 is maintained in position by a plurality of vanes 51 extending between the nose portion 53 and the adjacent walls of conduit half 10*b*. Vanes 51 retain magnet 50 in conduit half 10*b*, leaving the remainder of magnet 50 to freely depend within the cylindrical region 11 of conduit half 10*a*. Each vane is constructed from a suitable non-magnetizable material, such as stainless steel, and in the illustrated form is affixed to both the nose portion 53 and the walls of conduit half 10*b* by welding. Vanes 53 are also characterized by a narrow, aerodynamic frontal profile. As shown, the cross-section of each vane includes a taper in the direction of conduit inlet 22. The tapers define generally "V"-shaped aerodynamic leading edges 52 which assist in preserving laminar flow of air passing through the conduit in pneumatic applications.

Still referring to FIG. 5, the walls of both conduit halves 10*a*, 10*b* are of uniform thickness, such that the interior and exterior dimensions of the device 1 correspond. It will be understood by those skilled in the art that the interior dimensions of the device 1 are related to the rate of air flow through the conduit. In the illustrated form, the present invention is designed to maximize contaminant capture by the magnet 50. However, other conduit dimensions are certainly possible without departing from the patentable features of this invention.

Figure 6:
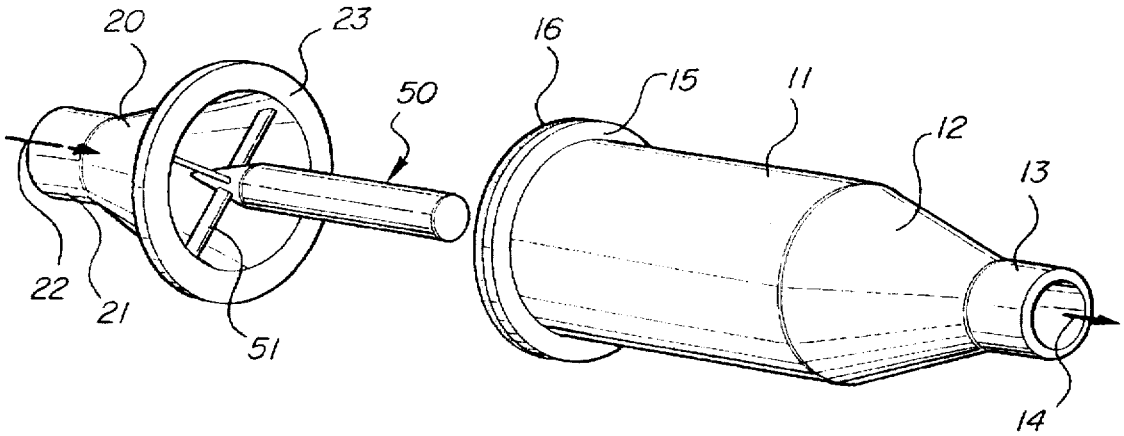
FIG. 6 is an exploded perspective view of the device of the present invention, showing the collar in an unattached condition.
Figure 6:
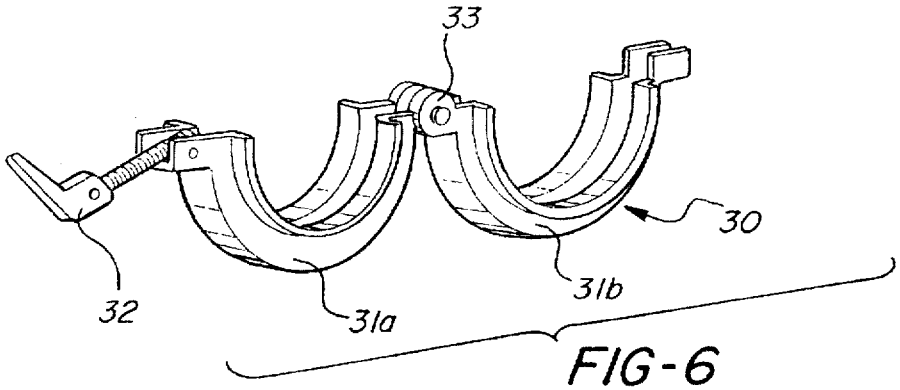

Axial mating of conduit halves 10*a* and 10*b* is depicted in FIGS. 5 and 6. As shown, annular shoulders 23 and 15 have similar radial dimensions. Interposed between them is a similarly shaped compressible gasket 16, having two axial mating surfaces 17 and 18. For ease of assembly and disassembly of the present invention, gasket 16 is attached at one axial mating surface 17 to the adjacent axial mating surface of shoulder 15 (FIG. 6). Gasket 16 serves to maintain an air tight seal between annular shoulders 23 and 15, in order to preserve the velocity of air passing through the conduit. As such, the gasket is preferably made of rubber or similarly compressible polymer.

Also depicted in greater detail in FIGS. 5 and 6 is collar 30. Each half 31*a*, 31*b* of collar 30 is characterized by a generally "C"-shaped cross. section which defines a groove for receiving mated shoulders 23, 15 and gasket 16. This groove configuration prevents disassembly of the mated conduit halves without releasing the cam lock mechanism.

Figure 7:
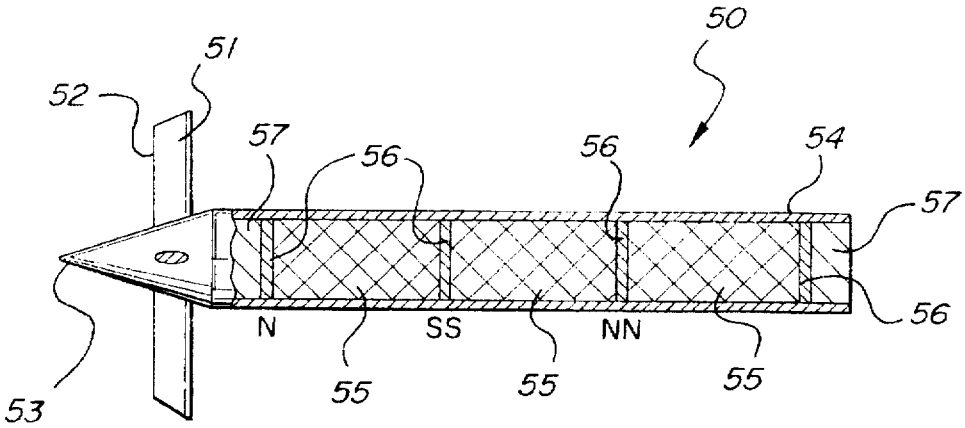
FIG. 7 is a cutaway view of the magnet element of the present invention, depicting the polar alignment of the individual magnets.

Referring now to FIG. 7, the magnet 50 of the present invention is most clearly exposed. Magnet 50 includes a metal housing 54, of which conical nose 53 defines an integral portion. This housing is preferably formed from stainless steel, or other suitable non-magnetizable material. Within housing 54 are contained a plurality of cylindrically-shaped magnetic elements 55. For purposes of this invention, a rare earth element is preferred for each magnet. However, it will be understood that any type of magnet or magnetizable element can be used without departing from the spirit of this invention. Magnetic elements 55 are arranged in spaced, axial fashion, with adjacent ends having the same polarity. Between each magnet, as well as covering the exposed ends of the two end-most magnets, are disposed spacers 56 constructed of a mild steel. Each spacer defines a solid, disc-shaped surface, having a diameter approximately the same as the interior diameter of housing 54. In this manner, spacers 56 fit securely within the housing 54, reducing interaction between the poles of adjacent magnets. Further included at either end of magnetic elements 55 are end plates 57. Each end plate is constructed of stainless steel, or other non-magnetizable metal, and is characterized by a cylindrical shape having a diameter similar to the interior diameter of the magnet housing. End plates 57 also fit securely into housing 54, maintaining the position of magnetic elements 55 therein.

In operation, the illustrated invention acts as a portion of the passage between a loading device, such as a vacuum loader, and a product receptacle, such as a gaylord (FIG. 1). As product is forced through the tubing by the flow of air, for example, product passes through the conduit and around the magnet 50 (FIG. 5). Tramp metal or other magnetizable contaminants passing through the device conduit are trapped the magnetic field around magnet 50. Due to the aerodynamic shapes of vanes 51 and conical nose 53, laminar flow over the magnet 50 is preserved, insuring maximum contaminant capture. Periodically, air flow is cut off and the device is opened (FIG. 6) for cleaning. Removal of collar 30 permits conduit halves 10*a* and 10*b* to be axially separated, exposing the entire magnetic portion of magnet 50. Because magnet 50 freely depends from conduit half 10*b*, complete removal of contaminants is insured by simply wiping the magnet 50 with a rag or gloved hand. Once the magnet is cleaned, conduit halves are axially mated and collar 30 is secured about annular shoulders 23, 15 and gasket 16. Air flow is resumed through the device until the next cleaning.

The invention in which an exclusive property or privilege is claimed is defined as follows:

1. In a magnetic separator assembly comprising a conduit designed to trap extraneous magnetizable material traveling in a path directed through said conduit, said conduit including at opposite ends thereof an inlet and an outlet and an intermediate section between said inlet and said outlet and having a magnet disposed therein, the improvement comprising:

said conduit having at least first and second portions comprising axially mating halves, said first half including said conduit inlet and said second half including said conduit outlet; and said magnet having at least one support member including a distal end at which said support member is connected to one of either of said halves of said conduit, such that said magnet is accessible by axially separating said at least first and second halves along said intermediate section, and wherein further said at least one support member extends from said magnet such that a majority of said magnet depends freely within said conduit proximate one of either of said inlet or said outlet.

2. The magnetic separator assembly of claim 1, wherein said magnet comprises a magnet-containing housing including an integral nose portion, said nose portion disposed toward said inlet of said conduit.

3. The device of claim 2, wherein said nose portion and the remainder of said magnet-containing housing have a common longitudinal axis.

4. The magnetic separator assembly of claim 2, in which said at least one support member extends from said nose portion, said at least one support member being affixed at its said distal end to said first half of said conduit.

5. The magnetic separator assembly of claim 4, wherein said nose portion has a generally conical shape, the smallest diameter of said conical shape being disposed adjacent to said conduit inlet.

6. The magnetic separator assembly of claim 5, in which said at least one support member comprises a vane having a leading edge disposed toward said inlet end of said conduit.

7. The magnetic separator assembly of claim 6, in which said vane tapers in the direction of said inlet such that said leading edge has a substantially "V"-shaped transverse cross-section.

8. The magnetic separator assembly of claim 7, in which said magnet-containing housing, said vane, and said integral nose portion are constructed from stainless steel.

9. The magnetic separator assembly of claim 2, wherein said second half of said conduit has a greater longitudinal axis than said first half of said conduit.

10. The magnetic separator assembly of claim 9, wherein said support member extends from said nose portion, said support member being connected at its said distal end to said first half of said conduit such that when said first and second halves of said conduit are axially mated a majority of said magnet-containing housing extends into said second half of said conduit.

11. The magnetic separator assembly of claim 10, wherein said first and second halves of said conduit include axial mating surfaces.

12. The magnetic separator assembly of claim 11, wherein each said first and said second halves of said conduit further include an annular shoulder extending radially therefrom, each said annular shoulder defining one of said axial mating surfaces.

13. The magnetic separator assembly of claim 12, in which each of said annular shoulders extends from each said first and said second halves of said conduit at an angle approximately perpendicular with respect to the longitudinal axis of each of said halves of said conduit.

14. The magnetic separator assembly of claim 13, further including a gasket compressibly sandwiched between said annular shoulders.

15. The magnetic separator assembly of claim 14, said gasket having first and second surfaces with radial dimensions substantially similar to said mating faces of said annular shoulders.

16. The magnetic separator assembly of claim 12, wherein said first and second halves of said conduit are each constructed from stainless steel.

17. A magnetic separator assembly comprising:

a conduit comprising first and second halves, said first half including a conduit inlet, and said second half including a conduit outlet, wherein said first and said second halves are axially mating to define an intermediate section of said conduit between said inlet and said outlet;

a magnet disposed within said intermediate section of said conduit; and a support member by which said magnet is connected to one of either said first or said second conduit halves such that at least a portion of said magnet depends freely within the other half of said conduit and is exposed by axially separating said first and second halves along said intermediate section.

18. The magnetic separator assembly of claim 17, wherein said magnet comprises a magnet-containing housing including an integral nose portion; said nose portion disposed toward said inlet of said conduit.

19. The magnetic separator assembly of claim 17, wherein said nose portion and the remainder of said magnet-containing housing have a common longitudinal axis.

20. The magnetic separator assembly of claim 17, in which said at least one support member extends from said nose portion, said at least one support member being affixed at its said distal end to said first half of said conduit.

21. The magnetic separator assembly of claim 20, wherein said nose portion has a generally conical shape being disposed adjacent to said conduit inlet.

22. The magnetic separator assembly of claim 21, in which said at least one support member comprises a vane having a leading edge disposed toward said inlet end of said conduit.

23. The magnetic separator assembly of claim 22 in which said vane tapers in the direction of said inlet such that said leading edge has a substantially "V"-shaped transverse cross-section.

24. The magnetic separator assembly of claim 23, in which said magnet-containing housing, said vane, and said integral nose portion are constructed from stainless steel.

25. The magnetic separator assembly of claim 17, wherein said second half of said conduit has a greater longitudinal axis than said first half of said conduit.

26. The magnetic separator assembly of claim 25, wherein said support member extends from said nose portion, said support member being connected at its said distal end to said first half of said conduit such that when said first and second halves of said conduit are axially mated a majority of said magnet-containing housing extends into said second half of said conduit.

27. The magnetic separator assembly of claim 26, wherein said first and second halves of said conduit include axial mating surfaces.

28. The magnetic separator assembly of claim 27, wherein each said first and said second halves of said conduit further include an annular shoulder extending radially therefrom, each said annular shoulder defining one of said axial mating surfaces.

29. The magnetic separator assembly of claim 28, in which each of said annular shoulders extends from each said first and said second halves of said conduit at an angle approximately perpendicular with respect to the longitudinal axis of said halves of said conduit.

30. The magnetic separator assembly of claim 29, further including a gasket compressibly sandwiched between said annular shoulders.

31. The magnetic separator assembly of claim 30, said gasket having first and second surfaces with radial dimensions substantially similar to said mating faces of said annular shoulders.

32. The magnetic separator assembly of claim 31 wherein said first and second halves of said conduit are each constructed from stainless steel.

33. In a magnetic separator assembly designed to trap extraneous magnetizable material travelling in a path directed through a conduit, said conduit including at opposite ends thereof an inlet and an outlet, and an intermediate section having a magnet-containing housing disposed therein, the improvement comprising:

said conduit having first and second axially mating halves, said first half including said inlet and said second half including said outlet;

said magnet-containing housing having at least one support member extending therefrom, said support member including a distal end at which said support member is connected to one of either of said conduit halves;

wherein said magnet-containing housing includes an integral nose portion disposed toward said inlet;

wherein said at least one support member extends from said nose portion, said at least one support member being affixed at its said distal end to said first conduit half;

wherein said nose portion has a generally conical shape, the smallest diameter of said conical shape being disposed adjacent said inlet;

wherein said at least one support member comprises a vane having a leading edge disposed toward said inlet;

wherein said vane tapers in the direction of said inlet such that said leading edge has a substantially "V"-shaped transverse cross-section; and wherein said magnet-containing housing, said vane, and said integral nose portion are constructed from stainless steel.

34. In a magnetic separator assembly designed to trap extraneous magnetizable material travelling in a path directed through a conduit, said conduit including at opposite ends thereof an inlet and an outlet, and an intermediate section having a magnet-containing housing disposed therein, the improvement comprising:

said conduit having first and second axially mating halves, said first half including said inlet and said second half including said outlet;

said magnet-containing housing having at least one support member extending therefrom, said support member including a distal end at which said support member is connected to one of either of said conduit halves;

wherein said magnet-containing housing includes an integral nose portion, said nose portion disposed toward said inlet;

wherein said second conduit half has a greater longitudinal axis than said first conduit half;

wherein said support member extends from said nose portion, said support member being connected at its said distal end to said first conduit half such that when said first and second conduit halves are axially mated a majority of said magnet-containing housing extends into said second conduit half;

wherein said first and second conduit halves include axial mating surfaces;

wherein each of said first and said second conduit halves further includes an annular shoulder extending radially therefrom at an angle approximately perpendicular with respect to the longitudinal axis of each said conduit half, each said annular shoulder defining one of said axial mating surfaces;

wherein a gasket is compressibly sandwiched between said annular shoulders, said gasket having first and second surfaces with radial dimensions substantially similar to said mating faces of said annular shoulders; and wherein said first and second halves are constructed from stainless steel.

35. In a magnetic separator assembly designed to trap extraneous magnetizable material travelling in a path directed through a conduit, said conduit including at opposite ends thereof an inlet and an outlet, and an intermediate section having a magnet-containing housing disposed therein, the improvement comprising:

said conduit having at least first and second axially mating halves, said first half including said conduit inlet and said second half including said conduit outlet;

said magnet-containing housing having at least one support member extending therefrom, said support member including a distal end at which said support member is connected to one of either of said halves of said conduit;

wherein said magnet-containing housing includes an integral nose portion, said nose portion disposed toward said conduit inlet;

wherein said second conduit half has a greater longitudinal axis than said first conduit half; and wherein said support member extends from said nose portion, said support member being connected at its said distal end to said first half of said conduit such that when said first and second halves of said conduit portion are axially mated a majority of said magnet-containing housing extends into said second half of said conduit.

36. In a magnetic separator assembly comprising a conduit designed to trap extraneous magnetizable material traveling in a path through said conduit, said conduit including at opposite ends thereof an inlet and outlet and an intermediate section between said inlet and said outlet and having a magnet disposed therein, the improvement comprising:

said conduit having said at least first and second portions comprising axially mating halves, said first half including said conduit inlet and said second half including said conduit outlet;

said magnet having at least one support member extending therefrom, said support member including a distal end at which said support member is connected to one of either of said halves of said conduit, such that said magnet is accessible by axially separating said at least first and second halves along said intermediate portion;

wherein said magnet comprises a magnet-containing housing including an integral nose portion, said nose portion disposed towards said inlet of said conduit;

wherein said at least one support member extends from said nose portion, said at least one support member being affixed at its said distal end to said first half of said conduit;

wherein said nose portion has a generally conical shape, the smallest diameter of said conical shape being disposed adjacent to said conduit inlet;

wherein said at least one support member comprises a vane having a leading edge disposed toward said inlet end of said conduit; and wherein said vane tapers in the direction of said inlet such that said leading edge has a substantially "V"-shaped transverse cross-section.

* * * * *

UNITED STATES PATENT AND TRADEMARK OFFICE

CERTIFICATE OF CORRECTION

PATENT NO. :5,740,919

DATED :April 21, 1998

INVENTOR(S) :Stowe

It is certified that error appears in the above-identified patent and that said Letters Patent is hereby corrected as shown below:

Col. 4, line 65, delete "device" and insert --magnetic separator assembly;

Col. 5, line 62, after "halves" insert --,--;

Signed and Sealed this

Seventeenth Day of November, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,740,919
DATED : April 21, 1998
INVENTOR(S) : Stowe

It is certified that error appears in the above-indentified patent and that said Letters Patent is hereby corrected as shown below:

Col. 6, line 3, delete "17" and insert --18--;

Col. 6, line 6, delete "17" and insert --19--.

Signed and Sealed this

Twenty-fifth Day of April, 2000

*Attest:*

Q. TODD DICKINSON

*Attesting Officer*

*Director of Patents and Trademarks*